United States Patent [19]

Zodrow

[11] 4,243,467

[45] Jan. 6, 1981

[54] LABELING MACHINE, ESPECIALLY FOR BOTTLES

[75] Inventor: Rudolf Zodrow, Duesseldorf, Fed. Rep. of Germany

[73] Assignee: Jagenberg Werke Aktiengesellschaft, Dusseldorf, Fed. Rep. of Germany

[21] Appl. No.: 922,464

[22] Filed: Jul. 6, 1978

[30] Foreign Application Priority Data

Sep. 9, 1977 [DE] Fed. Rep. of Germany ..... 2740656

[51] Int. Cl.[3] ..... B65C 9/16; B65H 3/20

[52] U.S. Cl. ..... 156/568; 118/231; 156/571; 156/DIG. 32; 271/33

[58] Field of Search ..... 156/567, 568, 571, 578, 156/DIG. 29, 30, 32; 271/33; 118/220, 231, 236, 240

[56] References Cited

U.S. PATENT DOCUMENTS

| | | | |
|---|---|---|---|
| 3,546,047 | 12/1970 | Dullinger | 156/571 |
| 3,735,731 | 5/1973 | Tavernier | 156/568 X |
| 3,919,040 | 11/1975 | Zodrow | 156/571 |
| 3,923,589 | 12/1975 | Tavernier | 156/568 |
| 3,928,120 | 12/1975 | Zodrow | 156/571 X |
| 4,077,621 | 3/1978 | Knuppertz et al. | 156/568 X |
| 4,092,206 | 5/1978 | Zodrow | 156/568 |

*Primary Examiner*—Michael G. Wityshyn

*Attorney, Agent, or Firm*—Sprung, Felfe, Horn, Lynch & Kramer

[57] ABSTRACT

A labeling machine has a revolving carrier on which at least one pickup element has a convexly curved receiving surface eccentrically journaled between the receiving surface and the center of curvature thereof. A drive is provided for each pickup element comprising a stationary cam and an arm which follows the cam and imparts to the pickup element an oscillating movement through a drive shaft. The stationary cam comprises a cylindrical cam truck and the drive shaft of each pickup element is coupled with the associated arm for movement by the stationary cam along the drive shaft through a cam consisting of two opposite parallel cam sections. The cam sections extend at an angle to a plane perpendicular to the shaft axis and cam followers are associated with these cam sections. The distance between the two cam sections is adjustable such that any free play present between them and the cam followers can be eliminated.

4 Claims, 6 Drawing Figures

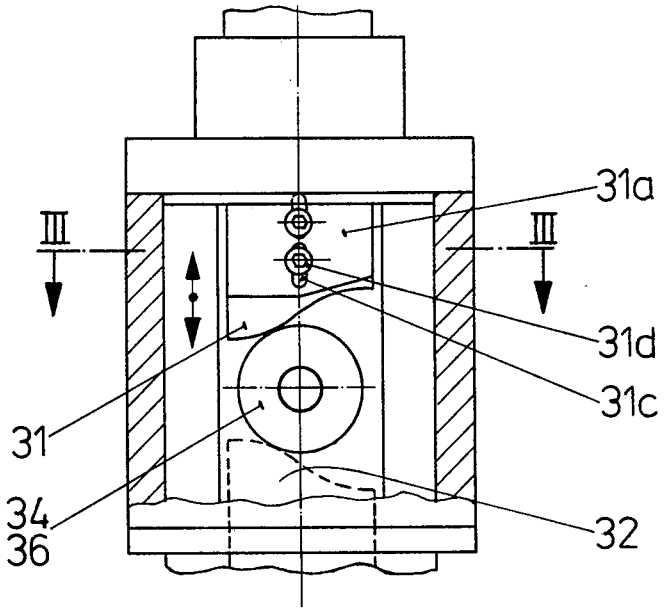
Fig. 5
Fig.6
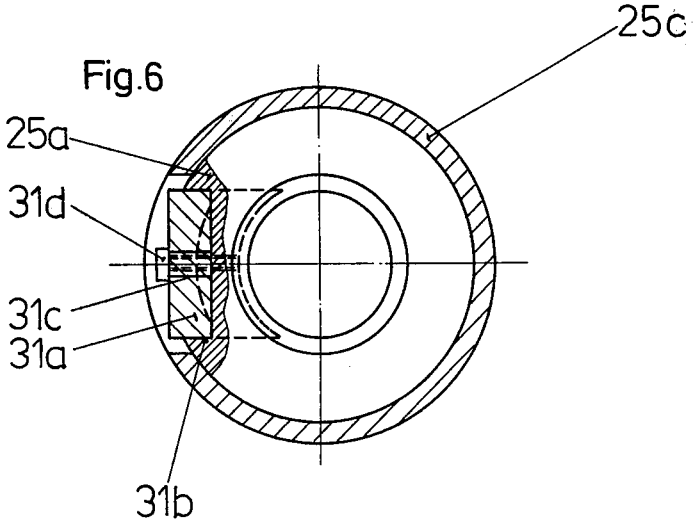

LABELING MACHINE, ESPECIALLY FOR BOTTLES

BACKGROUND

The invention relates to a labeling machine, especially for bottles, having a revolving carrier excentrically on which at least one pickup member having a convexly curved receiving surface is journaled, especially between the receiving surface and its center of curvature, and having a drive for each pickup element, which drive consists of a stationary cam and an arm which follows the cam and imparts an oscillating movement to the pickup element.

Such labeling machines are known (U.S. Pat. No. 1,179,422 and German Auslegeschrift No. 1,271,616).

In these machines the stationary cam is in one plane. When the carrier revolves, the arm following the stationary cam accordingly changes its radial position. On account of the varying radial distance, the arm is thus exposed to varying centrifugal forces. These varying forces apply varying stresses to the cam irrespective of the stresses involved in the acceleration of the pickup members. This results in premature wear at the points of greater stress. This wear, however, manifests itself as free play in the pickup element drive, so that the element is unable to perform its rolling action at the stations with the desired precision.

THE INVENTION

The object of the invention is to create a labeling machine in which the driving of the pickup elements will impart no additional stress to the mechanism, and in which any free play that may be present can be easily compensated for.

This object is accomplished in accordance with the invention in a labeling machine of the initially named kind, in that the stationary cam is a space curve cam or cylindrical cam track and the drive shaft of each pickup element is coupled with the associated arm, which is movable along the drive shaft by the stationary cam, by a cam consisting of two opposite, parallel cam sections and running at an angle to a plane perpendicular to the shaft axis and by cam followers associated with these cam sections, the distance between the two cam sections being adjustable such that any free play present between them and the cam followers can be eliminated.

With the labeling machine of the invention it is possible to apply labels very precisely, since the drive can be adjusted so as to have virtually no free play. Since the radial position of the drive elements remains unchanged during the rotation, there are no varying centrifugal forces, either, which would result in locally varying wear and hence free play.

In a first embodiment of the invention, which is intended especially for cam sections of inconstant slope, the two cam sections have an axially extending guide means securing them against rotation upon the adjustment of their distance apart. Independently of the configuration of the two cam sections, in this embodiment of the adjustment, the parallelism of the two cams is maintained, so that the cam followers cannot bind on the cam sections. If, however, the two cam sections have a constant slope, then the adjustment can also be accomplished by turning the two cam sections against one another. In this case, the parallelism preventing the binding of the cam followers is maintained.

Especially when the cam followers are in the form of rollers, it is advantageous for each cam follower to cooperate with only one cam section at a time. In the event of a stress change, the roller turning in one particular direction can continue to spin, since it is disengaged from the corresponding cam section, and this minimizes wear. Since the roller continues to spin in the same direction in the event of a stress change, it does not have to be accelerated from a standstill upon another stress change. This effect too has a wear-reducing effect. This low wear makes possible very precise labeling throughout the life of the parts. Furthermore, the fact that the cam followers are disposed oppositely and their position does not have to be changed when free play is eliminated also has a wear reducing effect, because, if the cam followers are in the form of rollers, they retain their optimum disposition with respect to the cam sections.

In a labeling machine of an older patent (German Patent Application P No. 27 30 030), opposite cam sections and rollers following these cam sections are provided, but the rotary movement produced between these elements by a stationary cam through an arm is superimposed on a self-rotation of the pickup elements which is produced by a planetary drive. In this labeling machine, the rotary movement produced at the cam sections and the rollers therefore produces only a correction of the self-rotation of the pickup elements, whereas in the labeling machine of the invention, the rocking movement required for the rolling of the pickup elements is produced entirely by the cam sections and the rollers.

BRIEF DESCRIPTION OF THE DRAWINGS

The invention will be explained below with the aid of a drawing representing a labeling machine, wherein FIG. 5 is a cross-sectional view taken along line II—II of FIG. 4, and FIG. 6 is a cross-sectional view taken along line III—III of FIG. 5, and turned 90°.

DETAILED DESCRIPTION OF THE INVENTION

Figure 1:
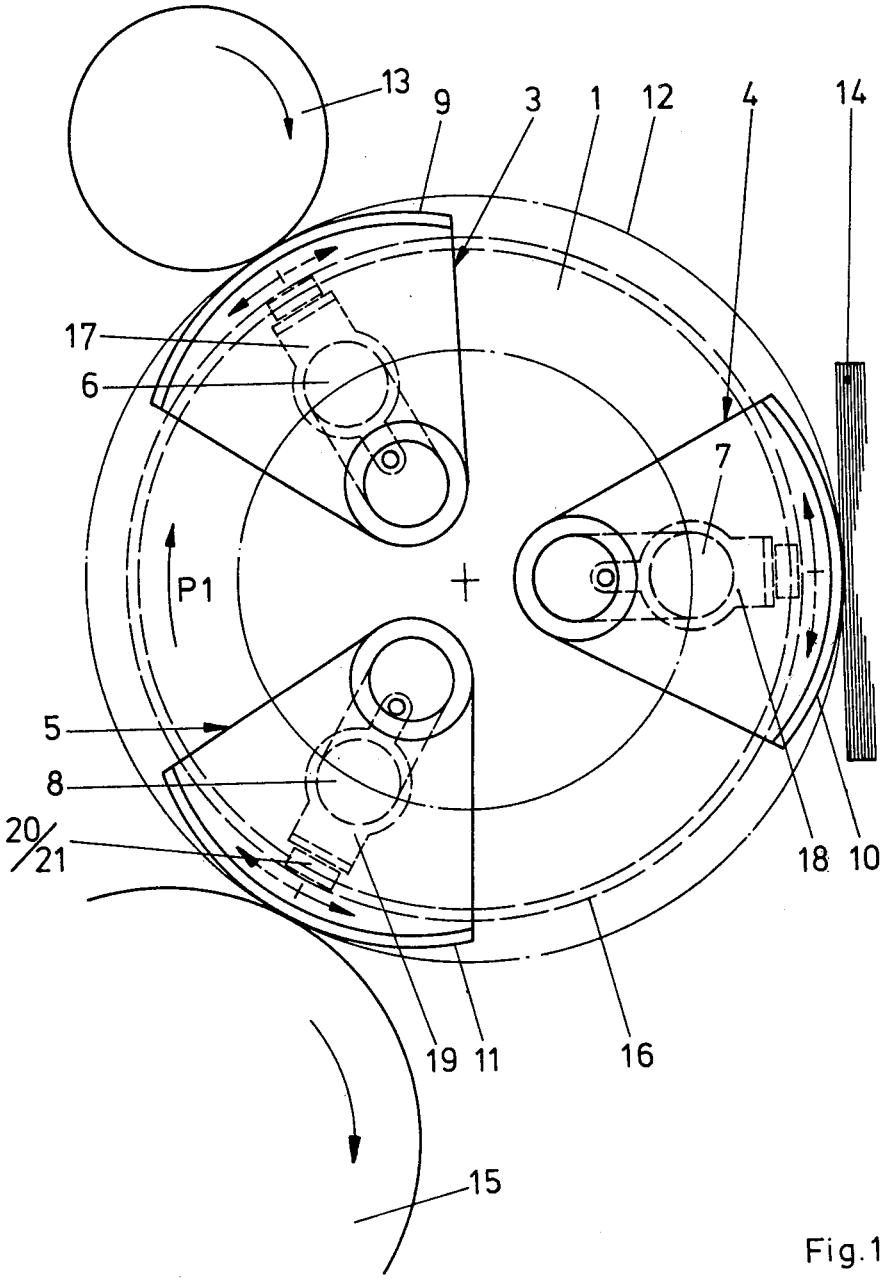
FIG. 1 is a diagrammatic plan view of a labeling machine.

The labeling machine represented in FIG. 1 has as the carrier an upper circular plate 1 and a lower circular plate 2, excentrically in which drive shafts 6, 7, 8, for pickup elements 3, 4, 5, are journaled. The drive shafts 6 to 8 are disposed symmetrically with the cylindrically curved receiving surfaces 9, 10, 11, of pickup elements 3, 4, 5, between the receiving surfaces 9, 10, 11, and their center of curvature. The various stations, namely a rotating glue roll 13, a stationary label stack 14 presenting a flat face, and a rotating labeling cylinder 15, are disposed tangentially to the circle 12 described by the receiving surfaces 9, 10, 11, in their middle position (as shown).

Figure 2:
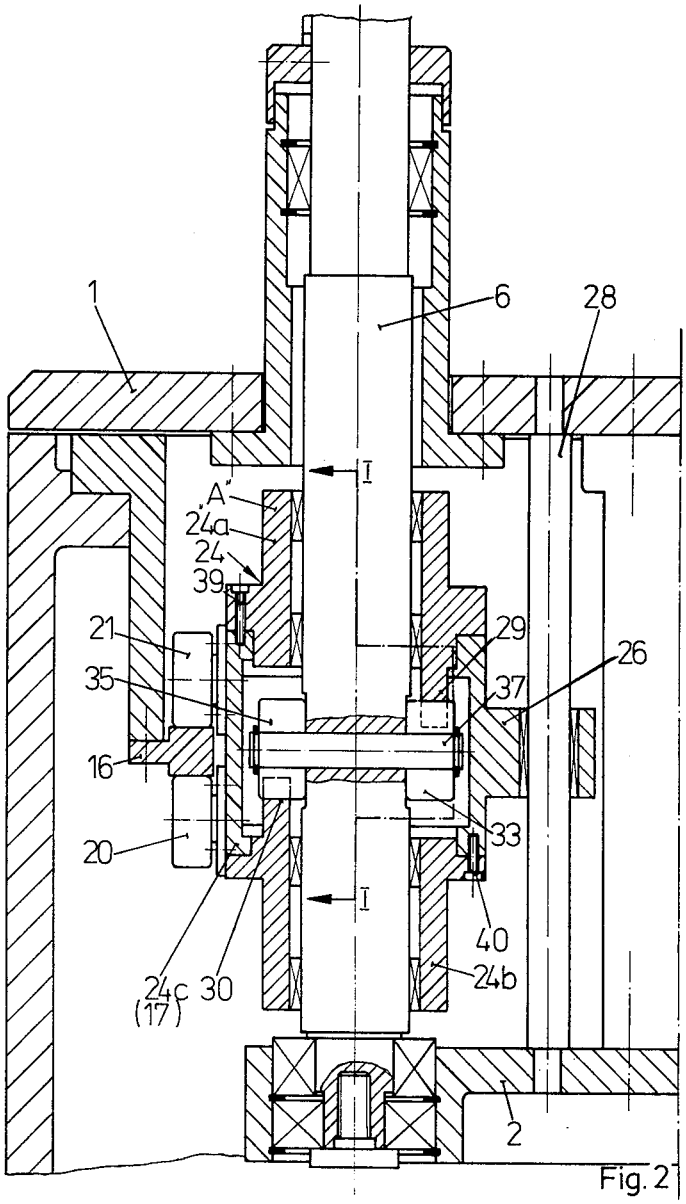
FIG. 2 is an axial cross section taken through the drive of a pickup element in a labeling machine in accordance with FIG. 1.
Figure 4:
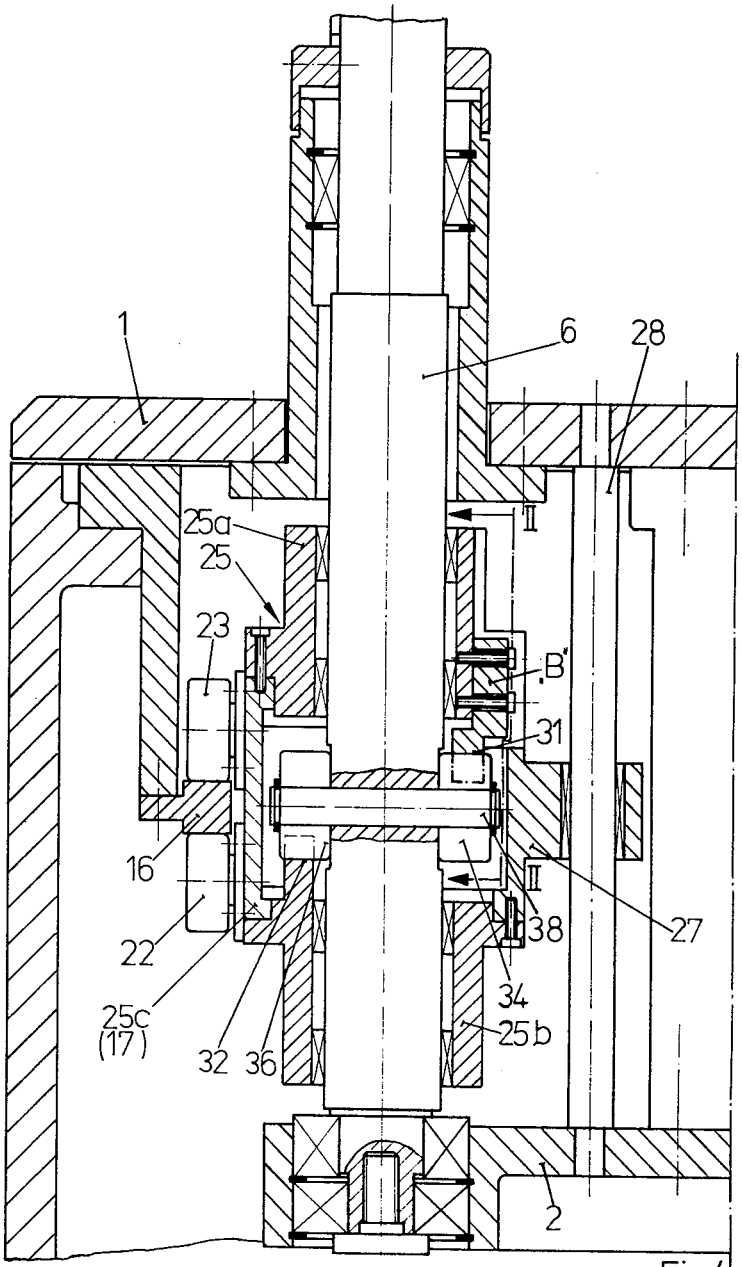
FIG. 4 is an axial cross section taken through a slightly modified drive of the pickup elements in a labeling machine of FIG. 1.

A stationary space-curved cam 16, which is a flange-mounted cam, and which is followed by arms 17, 18 and 19, serves for the driving of the pickup elements 3, 4, 5. To this end, as shown in FIGS. 2 and 4, each arm 17 has a lower and an upper roller 20, 21, 22, 23, between which the space-curved cam 16 runs. In both examples, the arm bearing the cam follower rollers 20 to 23 is part of a unit 24, 25, which is mounted for axial displacement on the drive shaft 6, and which consists of an upper and a lower bearing sleeve 24*a*, 25*a*, 24*b*, 25*b*, and a collar 24*c*, 25*c*, which is clamped between them and bears the rollers 20 to 23 and a guiding projection 26, 27. Through the guiding projection 26, 27, passes a guiding rod 28 which is held in plates 1, 2, parallel to the drive shaft 6. In this manner the unit 24, 25, is axially displaceable while being held against rotation thereon.

Figure 3:
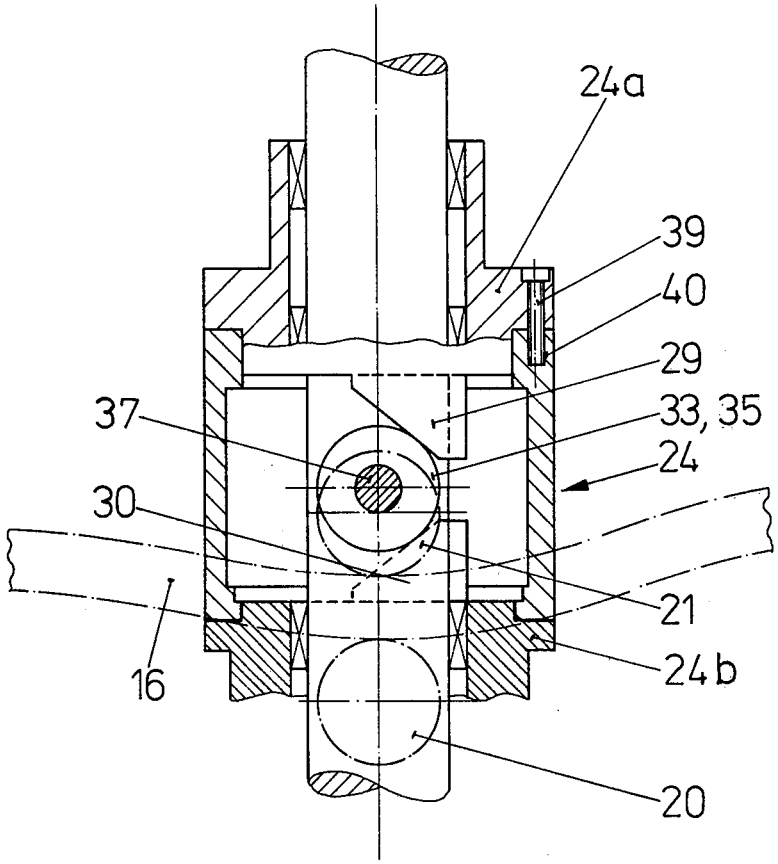
FIG. 3 is a cross-sectional view taken along line I—I of the drive represented in FIG. 2.

The upper bearing sleeve 24*a*, 25*a*, and the lower bearing sleeve 24*b*, 25*b*, each carry a cam section 29, 30, 31, 32. The two cam sections 29 to 32 are disposed diametrically opposite one another and run parallel to one another. In the embodiment represented in FIG. 2, the cam pitch is constant, as shown in FIG. 3, while in the embodiment shown in FIG. 4, the pitch varies along the length of the cam, as shown in FIG. 5. With each cam section 29 to 32 there is associated as the cam follower a roller 33, 34, 35, 36. The two rollers 33 to 36 are journaled on a shaft 37, 38, passing centrally through the drive shaft 6.

The operation of the two embodiments thus far described is as follows:

Upon the rotation of the carrier in direction $P_1$, i.e., the rotation of the two plates 1, 2, the unit 24, 25, is axially displaced on the shaft 6 depending on the configuration of the cam 16. Since the shaft 6 is axially undisplaceable but is journaled in plates 1, 2, the axial displacement of unit 24, 25, and with it also the cam sections 29 to 32, produces through rollers 33 to 36 a turning of the drive shaft 6 of the pickup element. The configuration of the stationary cam 16 is such that the pickup elements perform an oscillating movement. By means of the configuration of the stationary cam 16 and the configuration of the cam sections 29 to 32 and their coordination with one another, it can be brought about that the oscillating movement will take place with accelerations and retardations upon the passing of the individual stations 13 to 15 such that the receiving surface will roll against the individual stations, especially against the face of the label stack.

In the embodiment shown in FIG. 2, in which the cam sections 29, 30, have a constant pitch, as shown in FIG. 3, the axial distance between the two bearing sleeves 24*a*, 24*b*, is reduced to eliminate free play at rollers 33, 35, by loosening the screws 39, 40, and turning the two bearing sleeves 24*a*, 24*b*, against one another. On account of the constant pitch, the parallelism of the two cams is thus preserved over the entire length of the cam sections.

In the embodiment shown in FIG. 4, however, in which the pitch of the cam sections 32, 31, varies over their length, as shown in FIGS. 5 and 6, other measures are taken for the purpose of eliminating any free play that may develop between the cam sections 31, 32, and the rollers 34, 36. In this embodiment the cam section 31, as shown in FIG. 6, is secured against rotation by a projection 31*a* in a guide slot 31*b* extending axially in the bearing sleeve 25*a*. By means of two screws 31*d* engaging in elongated holes 31*c* in the projection 31*a*, the cam section 31 is held on the bearing sleeve 25*a*. Upon loosening the screw 31*d*, the cam section 31 can thus be shifted axially towards the other cam section 32 to eliminate free play.

It will be appreciated that the instant specification and claims are set forth by way of illustration and not limitation, and that various changes and modifications may be made thereto without departing from the spirit and scope of the present invention.

What is claimed is:

1. In a labeling machine for bottles and the like, having a revolving carrier on which at least one pickup element having a convexly curved receiving surface is eccentrically journaled between the receiving surface and the center of curvature thereof, and having a drive for imparting an oscillatory movement to each pickup element for each revolution of the carrier, comprising a stationary cam fixedly mounted in the machine such that the carrier is rotatable with respect to the cam and a drive shaft for each pickup element, the improvement comprising: the stationary cam comprising a cylindrical cam track and means disposed around each drive shaft and axially movable thereabout for coupling the drive shaft for each pickup element with the cam track, each coupling means comprising a cam axially movable along the shaft including two opposite, parallel cam sections sloping axially along the periphary of the shaft, cam followers associated with the cam sections and connected to the drive shaft to be rotatable therewith, means for adjusting the distance between the two cam sections to eliminate any free play present between the two cam sections and the cam followers and a guide rod disposed parallel to the drive shaft and fixed to the carrier and along which the coupling means is axially slidable for preventing rotation of the coupling means around the shaft.

2. The labeling machine according to claim 1, wherein the two cam sections have an inconstant pitch and axially extending guide means to secure them against rotation around the shaft upon the adjustment of their distance apart.

3. The labeling machine according to claim 1, wherein the two cam sections have a constant pitch and are rotatable relative to one another about the shaft for the adjustment of their distance apart.

4. The labeling machine according to claim 1, wherein the cam sections are diametrically opposed relative to the shaft axis and the cam followers comprise two rollers diametrically opposite to one another in relation to the drive shaft axis.

* * * * *